US006575541B1

(12) United States Patent
Hedrick et al.

(10) Patent No.: US 6,575,541 B1
(45) Date of Patent: Jun. 10, 2003

(54) TRANSLUCENT MONITOR MASKS, SUBSTRATE AND APPARATUS FOR REMOVABLE ATTACHMENT TO GAMING DEVICE CABINET

(75) Inventors: Joseph R. Hedrick, Reno, NV (US); Kehl T. LeSourd, Reno, NV (US); Kirk A. Tedsen, Reno, NV (US)

(73) Assignee: IGT, Reno, NV (US)

( * ) Notice: Subject to any disclaimer, the term of this patent is extended or adjusted under 35 U.S.C. 154(b) by 35 days.

(21) Appl. No.: 09/686,243

(22) Filed: Oct. 11, 2000

(51) Int. Cl.[7] ..... A63B 71/00

(52) U.S. Cl. ..... 312/223.1; 312/7.2; 292/106

(58) Field of Search ..... 312/7.2, 223.2, 312/265.5, 265.6, 215, 216, 217, 218, 222, 220; 348/836, 839, 841; 292/106

(56) References Cited

U.S. PATENT DOCUMENTS

| | | | | |
|---|---|---|---|---|
| 2,750,587 | A | * | 9/1956 | Nicholson et al. ..... 348/823 |
| 4,006,300 | A | * | 2/1977 | Boldt et al. |
| 4,063,289 | A | * | 12/1977 | Veenendaal |
| D275,208 | S | | 8/1984 | Nutting |
| D275,209 | S | | 8/1984 | Nutting |
| 4,517,558 | A | * | 5/1985 | Davids |
| D284,592 | S | | 7/1986 | Drews et al. |
| 4,648,600 | A | | 3/1987 | Olliges |
| 4,695,053 | A | | 9/1987 | Vazquez, Jr. et al. |
| 4,813,675 | A | | 3/1989 | Greenwood |
| 4,898,555 | A | * | 2/1990 | Sampson |
| D307,771 | S | | 5/1990 | Cesaroni et al. |
| 4,991,848 | A | | 2/1991 | Greenwood et al. |
| 5,611,535 | A | | 3/1997 | Tiberio |
| 5,662,204 | A | * | 9/1997 | Menke et al. ..... 194/215 |
| 5,742,360 | A | * | 4/1998 | Kwon et al. ..... 220/325 |
| D400,597 | S | | 11/1998 | Hedrick et al. |
| D403,363 | S | | 12/1998 | McGahm et al. |
| D404,084 | S | | 1/1999 | Hedrick et al. |
| D404,436 | S | | 1/1999 | McGahn et al. |
| D406,615 | S | | 3/1999 | Griswold et al. |
| D412,347 | S | | 7/1999 | DeSimone et al. |
| D416,054 | S | | 11/1999 | McGahn et al. |
| 5,984,781 | A | | 11/1999 | Sunaga |
| 6,012,982 | A | | 1/2000 | Piechowiak et al. |
| D421,277 | S | | 2/2000 | McGahn et al. |
| 6,056,642 | A | | 5/2000 | Bennett |
| 6,102,499 | A | * | 8/2000 | Chen et al. ..... 312/223.2 |
| 6,102,798 | A | | 8/2000 | Bennett |
| 6,113,098 | A | | 9/2000 | Adams |
| 6,161,805 | A | | 12/2000 | Wells |
| 6,164,645 | A | | 12/2000 | Weiss |
| 6,168,522 | B1 | | 1/2001 | Walker et al. |
| 6,257,682 | B1 | * | 7/2001 | Liu et al. ..... 312/223.2 |

OTHER PUBLICATIONS

Slot Machines published by Reno–Tahoe Specialty, Inc. in 1989.
Elvis Brochure published by IGT in 1999.
Totem Pole Brochure published by IGT in 1997.
Slotopoly Brochure published by IGT in 1998.
Wheel of Fortune Video published by IGT in 1999.
Wheel of Fortune Brochure published by IGT in 1998.
Mega Jackpots Brochure published by IGT in 1998.
Top Dollar Brochure published by IGT in 1998.
Morph Game Pictures published by IGT on Sep. 12, 1999.

* cited by examiner

*Primary Examiner*—Janet M. Wilkens
(74) *Attorney, Agent, or Firm*—Bell, Boyd & Lloyd LLC

(57) ABSTRACT

A removable translucent mask for use with a gaming device having a cabinet. The mask includes a first mask member adapted to removably connect to the cabinet having spaced-apart top and bottom members and spaced apart side members joined to and integral with the top and bottom members. The mask further includes a second mask member adapted to connect to the first member having spaced apart top and bottom members and spaced apart side members joined to and integral with the top and bottom members. A locking mechanism joined to the cabinet is adapted to removably connect the first and second mask members to the cabinet.

34 Claims, 3 Drawing Sheets

TRANSLUCENT MONITOR MASKS, SUBSTRATE AND APPARATUS FOR REMOVABLE ATTACHMENT TO GAMING DEVICE CABINET

CROSS-REFERENCE TO RELATED APPLICATIONS

This application is related to the following commonly-owned co-pending patent applications: "MODULAR CABINETS AND REPLACEABLE LAMINATE PANELS FOR A GAMING DEVICE," Ser. No. 09/690,705, "PLAYER INTERFACE AND TRAY FOR A GAMING DEVICE," Ser. No. 29/130,983, "PROTECTED COIN TRAY FOR USE WITH A GAMING DEVICE," Ser. No. 09/685,186, "GAMING DEVICE HAVING A DOOR WITH A MOVEABLE OR REMOVABLE BOLSTER," Ser. No. 60/239,376, "DISPLAY AND MASK FOR A GAMING DEVICE," Ser. No. 29/130,997, "DISPLAY AND MASK FOR A GAMING DEVICE," Ser. No. 29/131,001, "DISPLAY AND MASK FOR A GAMING DEVICE," Ser. No. 29/131,076, "TRAY FOR A GAMING DEVICE," Ser. No. 29/130,981, "PLAYER INTERFACE WITH BOLSTER FOR A GAMING DEVICE," Ser. No. 29/130,980, "PLATE FOR A MIDSECTION OF A GAMING DEVICE," Ser. No. 29/130,992, "TOP UNIT AND BASE FOR A GAMING DEVICE," Ser. No. 29/130,979, "BASE FOR TOP UNIT OF A GAMING DEVICE," Ser. No. 29/130,982, and "GAMING DEVICE," Ser. No. 29/130,996.

DESCRIPTION

The present invention relates in general to a monitor mask, and more particularly to removable translucent monitor masks, a substrate therefore and locking mechanism therefore used with a gaming device.

BACKGROUND OF THE INVENTION

Gaming devices such as slot machines currently exist that use displays or monitors to provide or exhibit the gaming scheme of the gaming device. Certain of these gaming devices include a single monitor mask that surrounds the display or monitor in the gaming device. Such known monitor masks are generally a modular or single unit, which surround the display and are attached to the gaming device cabinet in a movable (i.e., openable) manner.

These monitor masks generally use some type of hinge or supports that enable the device to be opened for access to the monitor and the controls contained therein. One problem is that these hinges and supports can become defective or inoperable, so that the monitor mask may not open or stay open. In addition, these hinges or systems can injure or pinch the person who is operating the device. Furthermore, these devices require that the cabinet provide room to accommodate the hinges or supports, taking up space that could be used for other purposes, such as to accommodate a larger display.

SUMMARY OF THE INVENTION

The present invention overcomes the above shortcomings by providing removable translucent monitor masks, a substrate therefore and locking mechanism therefore used with a gaming device having a cabinet. The present invention generally provides a dual or multiple mask apparatus including an inner and outer mask which is adapted to removably engage or connect to a substrate. The present invention further generally provides a locking mechanism adapted to removably connect the substrate to the cabinet.

More particularly the present invention includes a substrate and inner and outer masks, each of the masks and substrate having spaced apart top, bottom and side members. Both the masks and the substrate are preferably single integral units of a molded plastic material. The top and bottom members of each of the masks include alternately spaced tabs and notches that co-act to removably connect the outer mask to the inner mask.

The inner and outer masks are preferably of different colors to provide a desired look to the gaming device. Preferably the masks are translucent and, in conjunction with a one or more lighting devices, provide back lighting and lighting effects for the display and the gaming device. The masks could be simultaneously lit, or lit individually with the same or different color illuminations in any suitable manner.

The present invention also includes a locking mechanism for removably securing the substrate (and the masks) to the cabinet of the gaming device. In one preferred embodiment, the substrate includes four hooks extending generally transversely from an inner edge of the side members and a locking mechanism that includes two slideable locking bars and locking members moveably joined to the cabinet. Each locking bar includes a biasing device that preferably biases the locking device to a closed position so that the substrate (and the masks) remain locked in place.

This configuration provides for the complete removal of the substrate and masks from the cabinet, and facilitated more efficient manufacture and repair of the gaming device. This configuration also enables old masks to be replaced with new masks representing different games on the gaming device.

It is therefore an object of the present invention to provide a multiple monitor masks for use with a gaming device.

It is a further object of the present invention to provide removable translucent masks, substrate and locking mechanism for use with a gaming device.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 2 is an exploded front perspective view of the display, the substrate, the inner mask and the outer mask of the present invention illustrating the relationship there between;

DETAILED DESCRIPTION OF THE INVENTION

Figure 1:
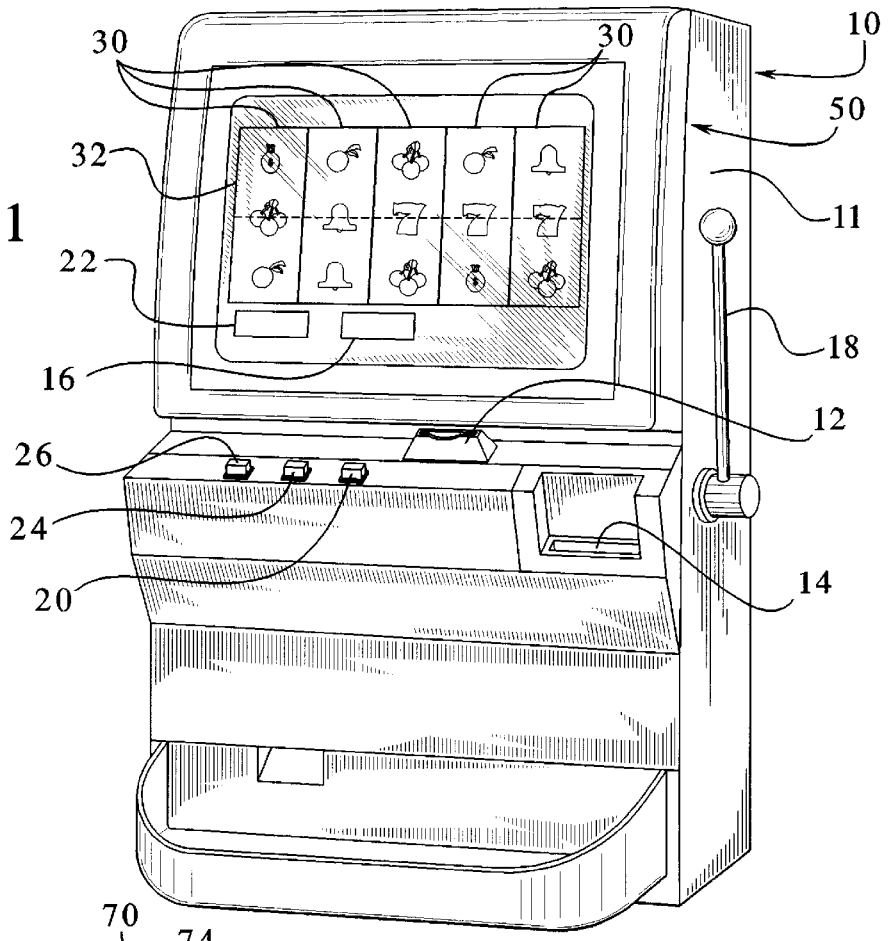
FIG. 1 is a front perspective view of one embodiment of the gaming device of the present invention.

Referring now to the drawings, a gaming device 10 of one embodiment of the present invention, which is preferably a slot machine having the controls, displays and features of a conventional slot machine is generally illustrated. Gaming device 10 having housing or cabinet 11 is constructed so that a player can operate gaming device 10 while standing or sitting. However, it should be appreciated that gaming device 10 can be constructed as a pub-style table-top game (not shown) which a player can operate preferably while sitting.

In one preferred embodiment, the gaming device 10 includes one or more illumination sources 301. These illumination sources could each be a single illumination device such as a single bulb, light emitting diode "LED", light beam, fluorescent tube or fiber optic cable; or a plurality of illumination devices such as a plurality of bulbs, LED's, beams, tubes or cables. It is also contemplated that the plurality of illumination devices could all be of one color or various colors.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18, pushing play button 20 or activating any other mechanism (including a touch screen) which starts the game.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 may include a display window (not shown) which contains a plurality of reels 30, preferably three to five reels in mechanical or video form. Each reel 30 displays a plurality of indicia such as bells, hearts, fruits, numbers, letters, bars or other images which preferably correspond to a theme associated with the gaming device 10. If the reels 30 are in video form, the gaming device 10 preferably displays the video reels 30 at display 32 instead of at a display window.

In one preferred embodiment, the display 32 is an LCD which is used to display images, symbols and other indicia including secondary games which represent a bonus game (a secondary game for which a bonus is awarded to the primary game). Furthermore, a plurality of smaller display could combine to form display 32 and used with the present invention.

The display 32 is selected from the group consisting of cathode ray tubes "CRTs", high resolution flat panel LCDs, projection type LCDs, plasma displays, field emission displays, digital micromirror displays, LCD touchscreens, flat TV displays or other suitable displays. The display 32 is capable of portraying or displaying images, symbols and other indicia including images of people, characters, places, things and card faces associated with the game. This display 32 generally attracts patrons to play the game.

Figure 3:
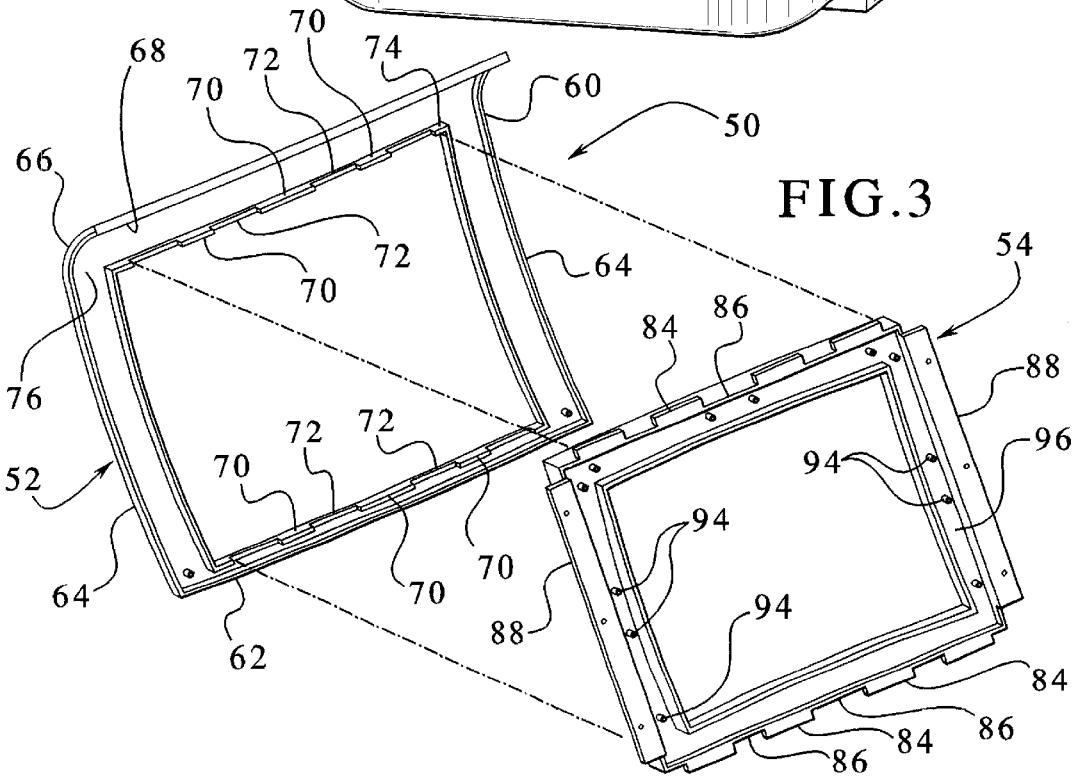
FIG. 3 is an exploded rear perspective view of the inner and outer masks of FIG. 2.
Figure 2:
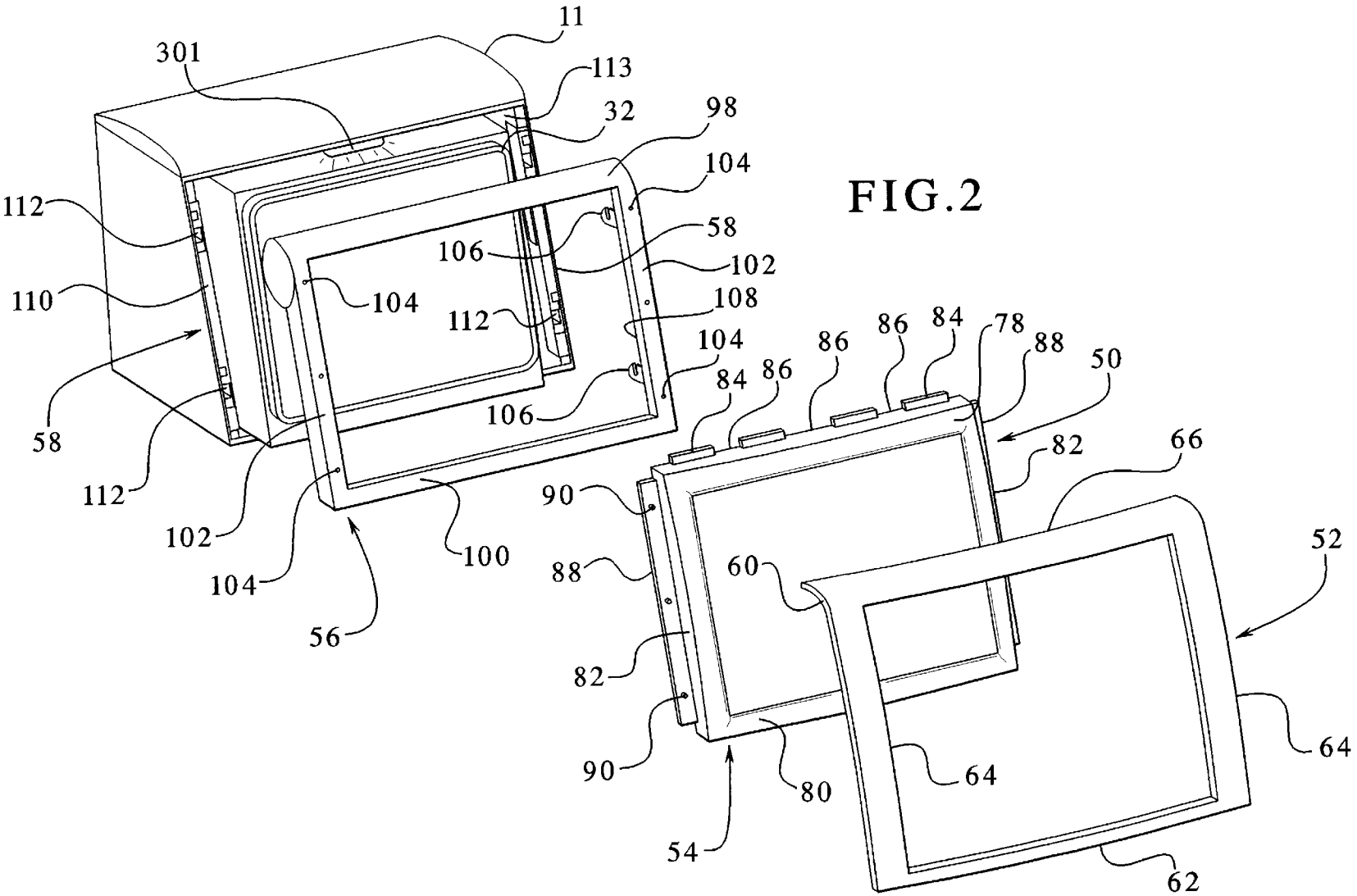

Turning now also to FIGS. 2 and 3, the present invention includes a dual or multiple mask apparatus 50 comprising inner and outer masks or mask members 54 and 52, respectively, which are adapted to removably engage a gaming device substrate 56. The gaming device 10 further includes a locking mechanism 58 adapted to removably engage the substrate 56 as described below.

This configuration provides for the complete removal of the substrate 56 and masks 52 and 54 from the cabinet 11, facilitating the manufacture and repair of the gaming device 10. This configuration also enables old masks to be replaced with a new mask representing new games or effects on the gaming device 10.

The first or outer mask 52 includes a top or first member 60 and a spaced-apart bottom or second member 62. In addition, the outer mask 52 includes spaced-apart side or third members 64 with are joined to and integral with the spaced apart top and bottom members 60 and 62. The outer mask 52 is preferably a single integral unit of a molded translucent plastic material. It should be appreciated that the outer mask 52 can be extruded, cut or manufactured in any conventional manner using plastic or any other suitable material such as acrylic, paperboard, glass, etc. The outer mask 52 is preferably formed as a single piece of clear or translucent material although colored or dyed material is also contemplated. While a single molded piece is preferred, it should be appreciated that the outer mask 52 could be formed from two or more pieces that are combined or otherwise joined to form an integral unit.

The outer mask 52 includes a curved upper edge 66 integral with and extending along the top or first member as illustrated in FIG. 3. A lip 68 connects to and extends transversely from the upper edge 66. Lip 68 is adapted to removably engage or connect to the cabinet 11 of the gaming device 10 (or a substrate 56 removably connected to the cabinet 11 of the gaming device 10).

Top and bottom members 60 and 62 of outer mask 52 include a locking mechanism for removably engaging or connecting to the inner mask 54. In one preferred embodiment, the locking mechanism includes a plurality of alternately spaced tabs 70 and notches 72. In the illustrated embodiment, a lip 74 extends transversely from outer mask 52, specifically from an inner surface 76 thereof, where tabs 70 and notches 72 are defined in an upper and lower portion thereof.

The inner mask 54 comprises spaced-apart top, bottom and side members 78, 80 and 82, respectively, similar to the outer mask 52 discussed previously. Like the outer mask 52, the inner mask 54 is preferably a single integral unit of a molded translucent plastic material although other manufacturing methods and materials are contemplated. Inner mask 54 is preferably formed as a single piece of clear or translucent material although colored or dyed material, or two or more pieces are also contemplated.

The inner mask 54 also includes a locking mechanism for removably connecting to the outer mask 52 as illustrated in FIG. 3. In one preferred embodiment, inner mask 54 includes tabs 84 and notches 86 that are spaced in accordance with and co-act with the tabs 70 and notches 72 of the outer mask 52. Preferably, the tabs 84 and notches 86 of the inner mask 54 engage and connect to the corresponding notches 72 and tabs 70 of the outer mask 52 in a removable manner. In the illustrated embodiment, the tabs 84 extend laterally from the outer edges 86 of the top and bottom members. It should be appreciated that the co-acting of the various tabs and notches properly align or position the two masks 52 and 54 with respect to each other and the display 32.

In the preferred embodiment, inner mask 54 includes two wings or members 88 extending from the spaced apart side members 82. A plurality of extending spacers 90 are joined to and integral with the wings or members 88. The spacers 90 contact or engage the inner surface 92 of the outer mask 52 ensuring that the inner 54 and outer masks 52 are properly spaced apart. In one embodiment, this spacing is used to accommodate an illumination device 301.

The inner mask 54 also includes a plurality of lugs 94 integral to and spaced about an inner surface thereof, preferably along the inner surface 96 of the side members 82. The lugs 94 are adapted to secure the inner mask 54 to the substrate 56 as discussed below.

The masks 52 and 54 are preferably different colors and may be back lit by one or more suitable illumination devices or sources 301 to provide a lighting effect around the display 32. The masks can be independently illuminated, simultaneously illuminated and illuminated in any desired combination or sequence. It should also be appreciated that the present invention contemplates the use of more than two monitor masks suitably connected to the substrate.

Gaming device 10 preferably includes a substrate or frame 56 that securely engages or connects to the gaming device cabinet 11. Like the inner and outer masks 54 and 52 discussed previously, the substrate 56 comprises spaced apart top, bottom and side members 98, 100 and 102 respectively as illustrated in FIG. 2. Substrate 56 is preferably formed from cold-rolled steel. It should be appreciated that the substrate 56 can be extruded, cut or otherwise manufactured in any conventional manner using other suitable metal materials, plastic or any other suitable material. The substrate 56 preferably has a suitable decorative coating such as plating.

In one preferred embodiment, the present invention further includes one or more locking mechanisms for removably securing the inner and outer masks 54 and 52 to the gaming device 10. The inner mask 54 includes a plurality of lugs 94 projecting from the inner surface 96 as described previously. The substrate 56 defines a plurality of indentations or hollows 104 in the spaced apart side members 102 that are spaced in accordance with and co-act with the lugs 94 of the inner mask 54. While the lugs 94 and indentations 104 are preferred, other means for removably connecting the inner mask 54 and substrate 56 are contemplated, including screws, hooks, double-sided tape, etc.

Figure 4:
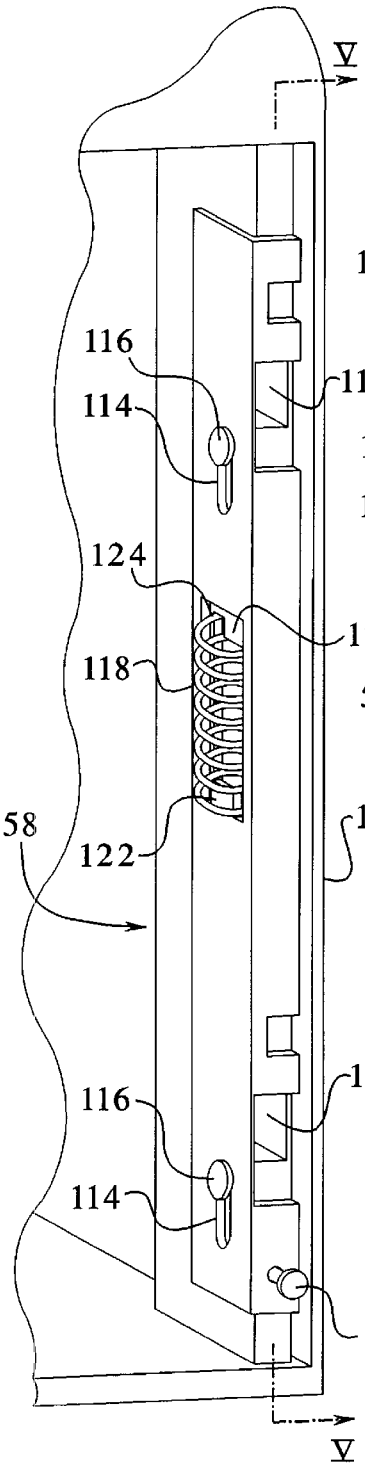
FIG. 4 is an enlarged sectional view of the gaming device of FIG. 1 illustrating the locking bar of the locking mechanism of the present invention.
Figure 5:
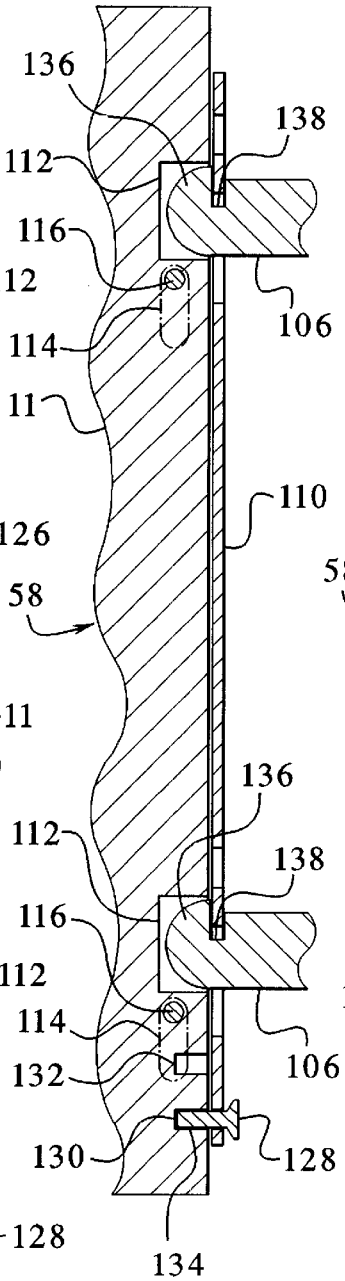
FIG. 5 is a cross-sectional view of the locking mechanism in a locked or engaged position taken substantially along line V—V of FIG. 4.
Figure 6:
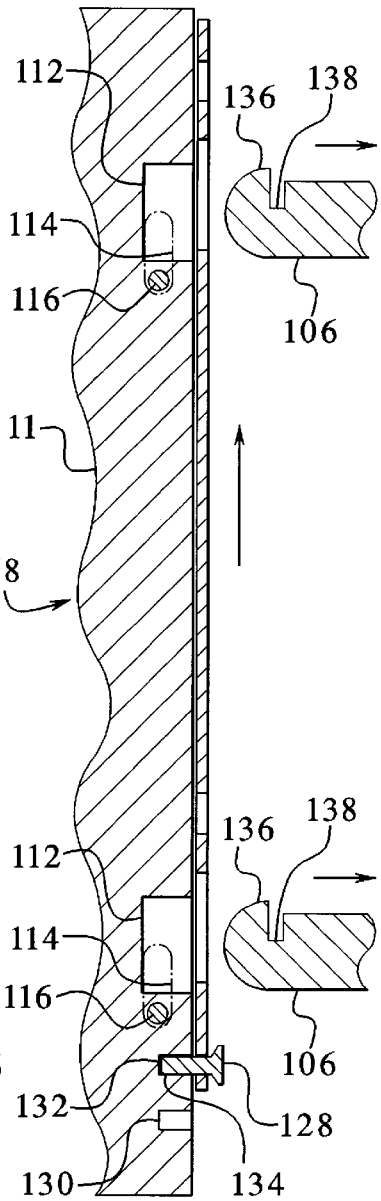
FIG. 6 is a cross-sectional view of the locking mechanism of FIG. 5 in an unlocked or disengaged position.

The present invention further includes a locking mechanism 58 for removably securing the substrate 56 to the cabinet 11 of the gaming device 10 as illustrated in FIGS. 4 through 6. In one preferred embodiment, substrate 56 includes at least one but generally two or more hooks 106 extending from inner edge 108 of the side members 102. In the illustrated embodiment, four hooks 106 extend generally transversely from the inner edge 108 of the side members 102. It should be appreciated that the hooks 106 are formed as part of and integral with the substrate 56 during the molding process. However it is also contemplated that the hooks 106 are formed as a separate integral unit of the same or different material as the substrate 56 and connected thereto.

In the preferred embodiment, the locking mechanism 58 includes at least one elongated portion and locking member joined to the cabinet 11 as illustrated. The locking mechanism 58 is adapted to removably connect the substrate 56 to the cabinet 11. In one preferred embodiment, the locking mechanism includes two elongated portions or slideable locking bars 110 located on either side of the display aperture 113 of the cabinet 11, placed parallel to the sides of the gaming device (best viewed in FIG. 2). Each slideable locking bar 110 defines at least one, but preferably two, engaging slots 112 spaced in accordance with and co-acting with the hooks 106. Additionally, each slideable locking bar 110 defines at least one but preferably two slots 114 that slideably secure the locking bar 110 to pegs or screws 116 extending from the cabinet 11.

Each locking bar 110 includes a biasing device that biases the locking bars 110 in a locked position to prevent unwanted removal of the substrate 56. In the illustrated embodiment, the locking bar 110 includes a spring 118 having a first end 120 connected to a peg 122 on the locking bar 110. A second end 124 of the spring 118 is connected to a peg 126 on the cabinet 11 and adapted to bias the locking bar 110 towards the closed position. While a spring 118 and pegs 122 and 126 are preferred, it should be appreciated that any biasing device (i.e., a spring bar) is contemplated.

The locking mechanism 58 further includes a locking member that locks the locking bar 110 in the closed or locked position. In the illustrated embodiment, the locking mechanism includes a plunger 128 extending generally transversely from each of the locking bars 110. The cabinet 11 defines at least one, but preferably two seats or sockets (referred to as first and second seats 130 and 132, respectively) that co-act with an engaging end 134 of the plungers 128. Preferably, each plunger 128 includes a spring (not shown) that biases the plunger 128 inwardly towards the seats 130 and 132 in a manner well known in the art.

In the closed position, the hooks 106 of substrate 56 sit in the engaging slots 112 and are engaged by the locking bar 110, so that at least a portion of the hooks 106 (i.e., at least the tip 136 and slot 138) engages, catches or "hooks" the locking bar 110. Moving the plunger 128 outwardly from the first seat 130 enables the locking bar 110 to slideably move towards the unlocked position, so that the sliding bar 110 no longer engages the hooks 106. The hooks 106 now sit "freely" in the engaging slots 112 and can be easily removed by pulling outwards on the substrate 56.

For example, an individual desiring to access the display or display control of the gaming device 10 reaches under the substrate 56 and pulls up on the plungers 128. Pulling up on the plungers 128 (i.e., away from the locking bar 110), disengages the plunger engaging ends 134 from the first socket 130. The locking bar 110 must be manually biased towards the open position against the spring 118 to move the locking bar 110 to the open position. In the illustrated embodiment, the locking bar 110 slideably moves along the pegs or screws 116 until the plunger engaging end 134 engages the second seat 132. The locking bar 110 no longer engages the hooks 106, which may now be removed from engaging slot 112.

The substrate 56 is replaced so that the hooks 106 engage the engaging slots 112. The plungers 128 are again pulled up so that the plunger engaging ends 134 disengage the second seat 132. The sliding bar 110 is moved back manually to the locked position (against the spring 118) so that the locking bar 110 engages the hooks 106 and the plunger engaging ends 134 engage the first seats 130.

An alternative embodiment is contemplated in which only one seat (i.e., the first seat 130) is defined and used to lock the locking bar 110 in the closed or locked position. The plunger 128 does not engage a second seat 132 to keep the locking bar 110 in the open or unlocked position. The locking bar 110 must be manually biased towards the open position. Furthermore, other embodiments are contemplated which include other locking members such as spring loaded balls and detents.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. A gaming device comprising:

a cabinet containing a display;

a substrate removably connected to the cabinet;

a first mask connected to an exterior side of said substrate and surrounding said display; and a second mask connected to an exterior side of the first mask and surrounding the display.

2. The gaming device of claim 1, wherein the first mask is removably connected to the substrate and the second mask is removably connected to the first mask.

3. The gaming device of claim 1, wherein the second mask is removably connected to the first mask.

4. The gaming device of claim 1, which includes a locking mechanism which removably connects the substrate to the cabinet.

5. The gaming device of claim 1, wherein the first mask is removably connected to the substrate.

6. The gaming device of claim 1, wherein the second mask includes a rounded edge adapted to removably engage the cabinet.

7. The gaming device claim 1, which includes at least one illumination device connected to the cabinet and adapted to illuminate at least one of the first and second masks.

8. A mask apparatus for use with a gaming device having a cabinet, said mask apparatus comprising:

a substrate adapted to removably connect to said cabinet;

a first mask member connected to an exterior side of said substrate; and a second mask member connected to an exterior side of the first mask member and said substrate.

9. The mask apparatus of claim 8, wherein the first mask member includes spaced apart top and bottom members and spaced apart side members joined to and integral with the top and bottom members.

10. The mask apparatus of claim 8, wherein the second mask member includes spaced apart top and bottom members and spaced apart side members joined to and integral with the top and bottom members.

11. The mask apparatus of claim 8, wherein the first and second mask members are removably connected to the substrate.

12. The mask apparatus of claim 8, which includes a hook connected to the substrate.

13. The mask apparatus of claim 12, wherein the hook is adapted to engage a locking mechanism.

14. A locking mechanism adapted to removably connect a mask apparatus to a gaming device cabinet, said locking mechanism comprising:

an elongated portion; and a biased locking member, whereby the biased locking member is adapted to lock the elongated portion in a closed position.

15. The locking mechanism of claim 14, which includes means for biasing the elongated portion towards the closed position.

16. The locking mechanism of claim 15, wherein the biasing means includes a spring.

17. The locking mechanism of claim 14, which includes an engaging member connected to the mask apparatus and adapted to be engaged by the elongated portion.

18. The locking mechanism of claim 17, wherein the engaging member is adapted to engage a seat defined by said gaming device cabinet.

19. The locking mechanism of claim 17, wherein said engaging member includes a hook that is engaged by the elongated portion.

20. The locking mechanism of claim 19, wherein the elongated portion defines a slot in spaced relationship and adapted to receive the hook.

21. A gaming device comprising:

a cabinet;

a first mask member removably connected to said cabinet by a locking mechanism, said locking mechanism including a biasing device which biases a portion of the locking mechanism in a closed position; and a second mask member connected to the first mask member.

22. A gaming device comprising:

a cabinet;

a first mask member removably connected to said cabinet by a locking mechanism, said locking mechanism including a spring loaded plunger which locks a portion of the locking mechanism in a closed position; and a second mask member connected to the first mask member.

23. A gaming device comprising:

a cabinet;

a first mask member removably connected to the cabinet, said first mask member including a first plurality of co-acting engaging members extending laterally from the first mask member; and a second mask member including a second plurality of co-acting engaging members extending substantially perpendicular from the second mask member, wherein each of the second plurality of co-acting engaging members co-acts with at least one of the first plurality of co-acting engaging members to removably connect the second mask member to the first mask member.

24. A gaming device comprising:

a mask including an engaging member;

a cabinet which defines a seat for the engaging member;

a moveable elongated portion connected to said cabinet and including one engaging slot adapted to receive the engaging member;

a biasing device connected to the elongated portion to bias said moveable elongated portion towards a closed position; and a biased locking member which locks said moveable elongated portion in the closed position in engagement with said engaging member which extends through the engaging slot and which is received by said seat.

25. The gaming device of claim 24, wherein the mask includes a plurality of engaging members, the moveable elongated portion includes a plurality of engaging slots, and the cabinet defines a plurality of seats.

26. The gaming device of claim 24, wherein said biased locking member includes a spring loaded plunger.

27. The gaming device of claim 24, which includes a second mask connected to the mask.

28. A locking mechanism for removably connecting a mask to a gaming device cabinet which defines a seat, the locking gaming device mechanism comprising:

a moveable elongated portion connected to said cabinet and including one engaging slot;

a biasing device connected to the elongated portion which biases said moveable elongated portion towards a closed position;

an engaging member connected to the mask; and a biased locking member which locks said moveable elongated portion in the closed position in engagement with said engaging member which extends through the engaging slot and which is received by said seat.

29. The locking mechanism of claim 28, which includes a plurality of engaging slots defined by the moveable elongated portion, a plurality of engaging members connected to the mask and a plurality of seats defined by the gaming device cabinet.

30. The locking mechanism of claim 28, wherein said biased locking member includes a spring loaded plunger.

31. The locking mechanism of claim 28, which includes a second mask connected to the mask.

32. A gaming device comprising:

a cabinet containing a display;

a substrate removably connected to the cabinet;

a first mask connected to the substrate and surrounding the display; and a second mask connected to the first mask and surrounding the display, wherein the second mask includes a rounded edge adapted to removably engage the cabinet.

33. A mask apparatus for use with a gaming device having a cabinet, said mask apparatus comprising:

a first mask member;

a second mask member adapted to connect to the first mask member; and a substrate removably connected to said cabinet, which includes a hook connected to the substrate, wherein said hook is adapted to engage a locking mechanism, and said substrate is connected to the first and second mask members.

34. A locking mechanism adapted to removably connect a mask apparatus to a gaming device cabinet, said locking mechanism comprising:

an elongated portion; and a biased locking member, whereby the biased locking member is adapted to lock the elongated portion in a closed position, wherein said biased locking member includes a spring loaded plunger.

* * * * *

UNITED STATES PATENT AND TRADEMARK OFFICE

CERTIFICATE OF CORRECTION

PATENT NO. : 6,575,541 B1 Page 1 of 1
DATED : June 10, 2003
INVENTOR(S) : Joseph Hedrick et al.

It is certified that error appears in the above-identified patent and that said Letters Patent is hereby corrected as shown below:

Column 2,
Lines 28-29, change “and facilitate more” to -- and facilitates more --.
Line 35, change “provide a multiple monitor masks” to -- provide multiple monitor masks --.
Lines 50-51, change “relationship there between” to -- relationship there-between --.

Column 6,
Line 58, change “the first seats 130” to -- the first seat 130 --.

Signed and Sealed this

Second Day of December, 2003

JAMES E. ROGAN
*Director of the United States Patent and Trademark Office*